United States Patent [19]

Fetchko

[11] Patent Number: 4,486,630

[45] Date of Patent: Dec. 4, 1984

[54] DEVICE FOR USE BY QUADRI-PLEGICS TO OPERATE A COMPUTER, VIDEO GAME OR THE LIKE BY THE USE OF MOVEMENTS OF THE JAW AND EYEBROWS

[76] Inventor: John E. Fetchko, 129 W. 46th St., Bayonne, N.J. 07002

[21] Appl. No.: 474,357

[22] Filed: Mar. 11, 1983

[51] Int. Cl.[3] ..... H01H 35/00

[52] U.S. Cl. ..... 200/52 R; 200/61.48; 200/DIG. 2; 338/153

[58] Field of Search ..... 200/52 A, 52 R, DIG. 2, 200/61.48, 61.49, 61.51; 338/153; 364/410, 709; 340/573, 575, 407, 709; 273/DIG. 28, DIG. 17, 85 G

[56] References Cited

U.S. PATENT DOCUMENTS

| | | | |
|---|---|---|---|
| 2,681,586 | 6/1954 | Pressler | 338/153 |
| 2,711,528 | 6/1955 | Glossbrenner | 200/52 R |
| 2,842,628 | 7/1958 | James | 200/52 R |
| 3,054,868 | 9/1962 | Phillians | 200/52 R |
| 3,229,059 | 1/1966 | Beatty | 200/61.41 |
| 3,363,242 | 1/1968 | Currey | 340/279 |
| 3,374,845 | 3/1968 | Selwyn | 340/573 |
| 3,586,798 | 6/1971 | Holmes | 200/52 R |
| 3,769,636 | 11/1973 | Friedman | 3/1.1 |
| 4,109,145 | 8/1978 | Graf | 340/825.19 |
| 4,260,035 | 4/1981 | Loveless | 180/6.5 |
| 4,338,488 | 7/1982 | Lennox | 179/1 AL |

*Primary Examiner*—E. A. Goldberg
*Assistant Examiner*—M. J. Reinhart
*Attorney, Agent, or Firm*—Gloria K. Koenig

[57] ABSTRACT

A headset for supporting electrical contact means which are operated by the movement of the jaw and/or the eyebrows is electrically connected to a computer, video game console or the like to provide educational and recreational opportunities to persons who can move only the jaw and eyebrows. A flexible chin strap formed with a chin cup supports a horizontally mounted chin bar having an electrode contact on one end. A housing having a plurality of sides, each inner face of which has mounted thereon an electrode connected to a computer interface is mounted around the chin bar electrode to provide a means for the user to establish contact between the chin bar electrode and one or more of the housing electrodes by up, down or sideward movement of the jaw. An adjustable head band formed to fit above the eyebrows of the user is formed with a contact electrode extending outwardly from the center portion of the headband between the eyes. A C-shaped housing having electrodes attached to the upper and lower arms, which electrodes are operationally connected to a computer interface, is mounted around the headband electrode to provide three switching possibilities, i.e., no contact when the eyebrows are relaxed, contact with the upper electrode when the eyebrows are raised and contact with the lower electrode when the eyebrows are lowered, as in a frowning motion. A straight track potentiometer with an outwardly extending control stick is mounted in contact with the second end of the chin bar to permit the operation of the potentiometer by the upward and downward motion of the user's jaw.

19 Claims, 22 Drawing Figures

CHIN BAR HOUSING ELECTRODES
PRIMARY IMPULSE NUMBER
POWER SOURCE
CHIN BAR ELECTRODE
19
Z
Y
X
W
N
M
L
G
F
E
O
I
H
P
R
K
C
D
A
124
125
122
123
121
120
9
8
7
6
5
4
3
2
1
TO HEAD BAND ELECTRODE 32
TO HEAD BAND ELECTRODE SYSTEM

DEVICE FOR USE BY QUADRI-PLEGICS TO OPERATE A COMPUTER, VIDEO GAME OR THE LIKE BY THE USE OF MOVEMENTS OF THE JAW AND EYEBROWS

BACKGROUND OF THE INVENTION

1. Field of the Invention

The present invention relates to a headset for use by quadriplegics by movements of the jaw and eyebrows to establish a specific electrical contact from among a plurality of electrical contact points which will permit the user to operate a computer, video game and the like.

2. Description of the Prior Art

Numerous devices are known which allow a quadriplegic person who can sit in a wheelchair to operate the movement of the chair by movement of the chin and neck, i.e., U.S. Pat. No. 4,260,035 or to operate an orthotic brace by using head orientation, i.e., U.S. Pat. No. 3,769,636. However, the devices disclosed in the aforesaid patents require some movement of the head. U.S. Pat. No. 4,338,488 teaches a headband device to actuate the switch of an electronic larynx. All of the aforesaid prior inventions appear to be limited to the use of head motion to actuate a simple array of switches which therefore limits the number of functions which the user can directly control.

SUMMARY OF THE INVENTION

The headset according to the present invention is designed for supporting electrical contact means which are operated by the movements of the jaw and/or the eyebrows of the user, permitting a quadriplegic to operate a computer or to play a video game. The headset is designed especially for use by a quadriplegic who can move only the jaw and eyebrows, although it can also be used without modification by persons who have greater mobility.

The headset comprises a semi-circular support bar which fits across the top of the head and is attached to two earpieces to maintain the headset in position and to support the electrical connections. An adjustable flexible chin strap having a chin cup is mounted between the earpieces and an adjustable, flexible headband is fitted under the head support bar. A chin bar having an electrode contact on one end extends outwardly and horizontally from the chin cup, the electrode being electrically connected to complete a circuit when in contact with an electrode connected to a computer signal as described below. A pliable boom extends downwardly from the earpiece on the side of the head from which the chin bar electrode extends. A housing is mounted at the end of the boom, the housing having a plurality of sides which are formed with one or more electrode contacts mounted on each inner face of the housing, one face of the housing having an opening through which the chin bar electrode enters the inside of the housing, the electrical connections of each electrode to a computer being supported in the earpiece. Each of the housing electrodes is electrically connected to a computer interface. In operation, the user moves his chin up or down or sidewards thereby making contact between the chin bar electrode and one or more of the housing electrodes, which in turn actuates a computer input/output signal.

A second pliable boom extends from the center portion of the head support bar and extends to the center of the flexible headband. A C-shaped housing is attached to the free end of the boom, with electrodes positioned on the inner surfaces of the upper and lower arms of the housing. A contact electrode is mounted to extend outwardly from the center portion of the flexible headband and between the arms of the C-shaped housing, the contact electrode being moved by the movement of the eyebrows, providing three switching possibilities, i.e., no contact when the eyebrows are relaxed, contact with the upper electrode when the eyebrows are raised, and contact with the lower electrode when the eyebrows are lowered, as in a frowning motion. For neatness and convenience, all electrical connections for the various electrodes are entwined around a single earpiece and then formed into a single cable to extend to the computer equipment to be operated. The chin bar electrode with the multiple electrode contacts in the chin bar electrode housing in combination with the headband electrodes provide a plurality of contacts to operate a computer.

A third pliable boom extends downwardly and forwardly from the second earpiece with a bar potentiometer having a straight track mounted at the free end of the boom, the track facing the second end of the chin bar and disposed vertically in respect to the chin bar. A control stick operationally mounted on the potentiometer and in contact with the chin bar is controlled by the downward motion of the user's jaw.

For use with video type games, the chin bar electrode making selective contact with the electrodes in the housing can be used to control the movements usually performed manually by persons with use of their hands with the Joystick Controller, while the headband electrodes can be operably connected to control the button program on the Joystick Controller. A second aspect of the invention concerns the use of the Paddle Controller and button of certain video games. The potentiometer mounted on the second side of the user's jaw is operably connected to operate the Paddle Controller programs while the headband electrodes control the button on the Paddle Controller system.

The electrode contact means set out herein are designed to be connected with commercially available computers and video computer system games, which in themselves form no part of the present invention. As it is understood by those familiar with computer technology, a computer contains a microprocessor unit, also known as a central processing unit, which controls the processing of data and the execution of instructions. Between the input/output devices and the microprocessor, there are connections that allow the signals to be utilized. These connections, called interfaces, are where the information from a computer keyboard becomes usable to the microprocessor. The electrical connections set out in this specification and claims by-pass the manually operated keyboard of a computer and video game controllers and connect to the wires leading to the interface connections.

It is therefore an object of this invention to provide a light, compact headset constructed with a plurality of electrode contacts which are connected to a computer or video game and which can be selectively activated by movement of the jaws and eyebrows.

It is a further object of this invention to provide a device which is not invasive of the body or its orifices and can be worn for long periods of time by the user without discomfort.

It is a further object of this invention to provide a device whereby a severely disabled person can operate a computer for educational and recreational purposes with very little outside assistance.

The above advantages and objects of this invention will become more apparent when considered with the details of construction and operation as more fully described hereinafter and illustrated in the accompanying drawings wherein like numerals refer to like parts throughout.

DESCRIPTION OF THE PREFERRED EMBODIMENTS

Figure 1:
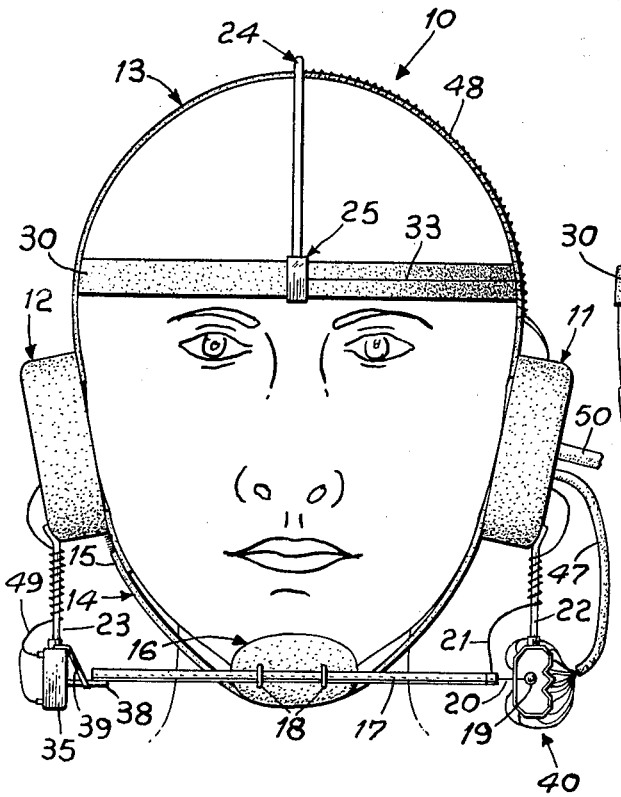
FIG. 1 is a front view in perspective of a preferred embodiment of the device secured to a user of the invention.
Figure 2:
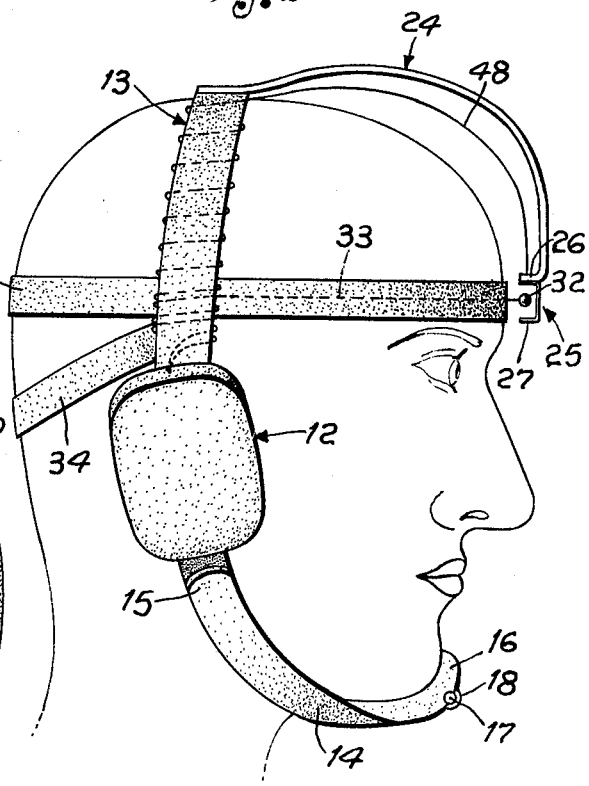
FIG. 2 is a left side view in which an ear boom and potentiometer are not shown.
Figure 3:
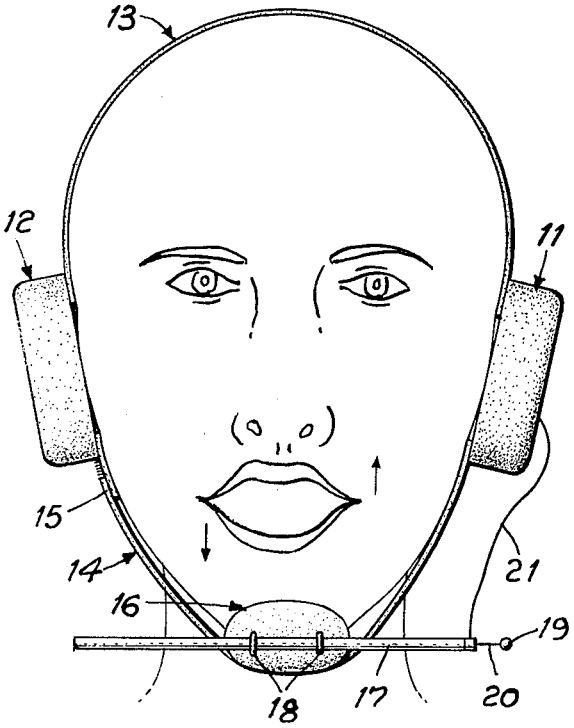
FIG. 3 is a front view of the chin strap with chin bar attached.

Referring now more specifically to the drawings, the headset device is shown generally at 10 in FIG. 1 as worn by a user. All designations of "right" and "left" sides referred to hereafter, refer to the side of the drawings as shown. Two earpieces 11, 12 are joined together by a semi-circular band of semi-rigid material which acts as a head set support bar 13. A chin strap 14, preferably formed of a stretchable material is attached to the ear pieces 11, 12 and is provided with adjustable securing means 15, such as, snaps, cooperating strips of hook and pile tape, such as Velcro or the like. An oval chin cup 16 formed with concavity to accomodate the chin is attached to the center area of the chin strap 14. A chin bar 17, which is a thin, rigid rod, is attached to the chin cup 16 by clips or other fastening means 18 and extends horizontally across and above the user's neck toward the shoulders, at least to the ends of the earpieces. The chin bar 17 is approximately 9 inches (23 cms.) in length from end to end. An electrode, hereinafter called the chin bar electrode 19, is removably attached to one end of the chin bar by a thin rigid conductive wire 20. As used herein, the term electrode is used to signify an electrical contact area. While the chin bar electrode can be shaped in various ways, as shown in FIG. 3, the chin bar electrode 19 is a small copper ball approximately one-sixteenth inch (0.2 cm.) in diameter attached to a rigid, insulated conductive wire 20, approximately one-thirty second inch (0.08 cm.) in diameter, which in turn is attached to and extends horizontally outward from one end of the chin bar 17. An insulated conductive wire 21, such as plastic coated copper wire is connected to the chin bar electrode and extends to the right earpiece 11 where it is electrically connected as will be described below.

Figure 5:
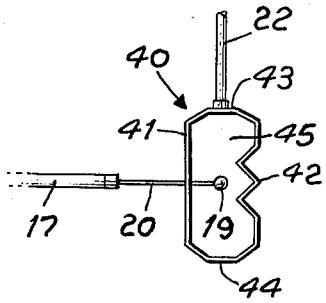
FIG. 5 is a front elevational view of the chin bar electrode housing.
Figure 7:
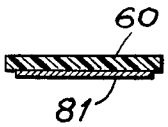
FIG. 7 is a sectional view along line 7—7 of FIG. 6.
Figure 8:
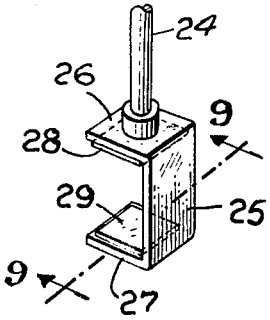
FIG. 8 is an enlarged elevational view of the headset electrode housing.
Figure 9:
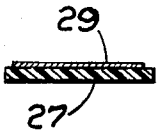
FIG. 9 is a sectional view along line 9—9 of FIG. 8.
Figure 11:
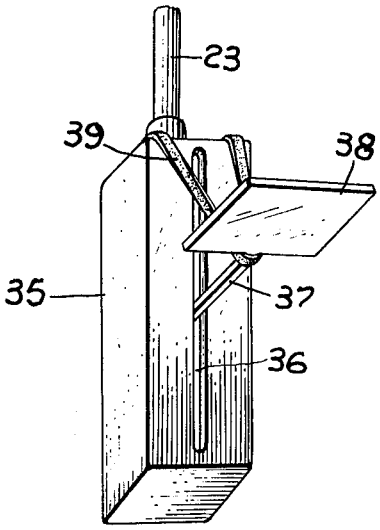
FIG. 11 is an enlarged perspective view of the potentiometer.
Figure 10:
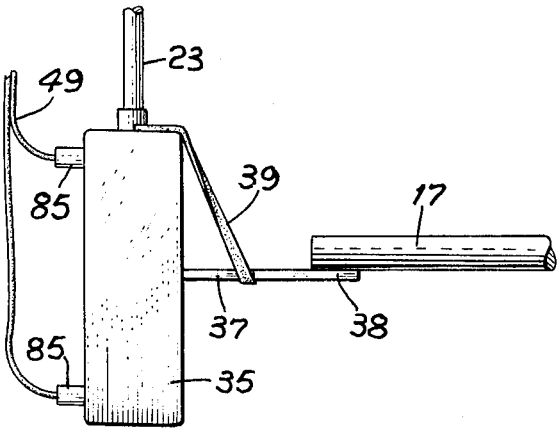
FIG. 10 is an enlarged elevational view of the chin bar and potentiometer.
Figure 12:
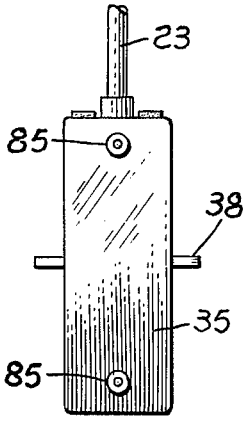
FIG. 12 is an enlarged plan view of the back of the potentiometer.
Figure 13:
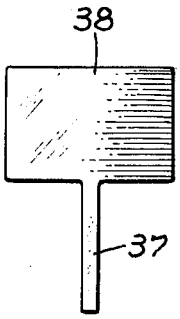
FIG. 13 is a plan view of the potentiometer control stick.

A pliable metal boom 22, approximately eight inches (20 cm.) in length, extends from the right earpiece 11 downwardly and forwardly to the area of the chin bar electrode 19. As shown in FIG. 5, an electrode housing 40 having a left end 41 nearest to the chin bar, a right end 42, top 43 and bottom 44 is formed with a plurality of peripheral sides and is mounted on the distal end of the boom 22. The front end 45 and back end (not shown) of the housing may be left open. One or more electrodes are attached to the inner face of each side of the housing 40 to provide a plurality of electrical contact points. Each housing electrode is formed by attaching a thin strip of conductive material, such as, copper to the inner face of each side of the electrode housing, a typical sectional view being shown in FIG. 7. Alternatively, the electrode can be made by painting an area of the inner face with a conductive paint, such as copper paint. The borders of the housing electrodes are formed to be no more than one-sixteenth of an inch (0.2 cm.) from one another.

Figure 6:
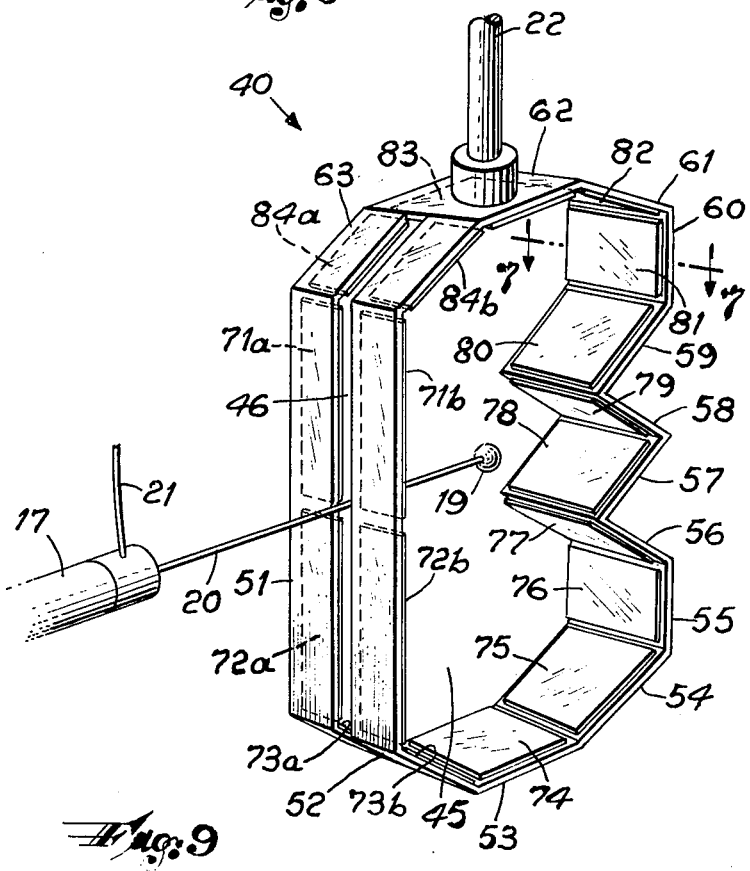
FIG. 6 is an enlarged perspective view of the chin bar electrode housing showing the position of the electrodes on the inner faces.

Referring now to FIG. 6, an electrode housing 40 having thirteen sides, numbered 51 to 63 respectively, is shown. The sides 51, 52 and 63 of the housing adjacent to the chin bar are formed with a channel 46 to provide an opening through which the wire 20 holding the chin bar electrode 19 can be inserted into the interior of the housing. The channel permits the movement of the chin bar electrode within the housing. Fourteen electrodes, numbered 71 to 84 respectively, are mounted on the inner faces of the sides of the electrode housing. Each electrode is individually wired to electrically connect to a computer when contact with the chin bar electrode completes the circuit. The electrical circuitry is well understood by those skilled in the art and is briefly described below. The individual wires exiting from each electrode are not shown in FIG. 6, but are combined into an insulated cable 47 which winds around the right earpiece 11 and then connects to the computer by means of cable 50.

A shown in FIG. 6, the individual sides 51, 52 and 63, forming the left end of the electrode housing are provided with electrodes which are split, 71*a*–71*b*, 72*a*–72*b*, 73*a*–73*b*, and 84*a*–84*b*, each split electrode being wired in series to act as a single electrode upon contact with the chin bar electrode. Electrode housing side 51 is provided with two pairs of split electrodes, 71*a*–71*b* and 72*a*–72*b*. The electrode housing has been constructed to have an overall height of approximately 1 inch (2.5 cm.) and width of one-half inch (1.3 cm.).

In operation the chin bar electrode 19 is inserted into the center area of the electrode housing 40 with the thin rigid wire 20 passing through the channel 46. The wire 20 is then mounted onto the chin bar by conventional means. The position of the electrode housing is adjusted by means of the boom 22, so that there is no contact between the chin bar electrode 19 and any housing electrode when the mouth of the user is slightly opened. The user can manipulate the chin bar electrode by movement of his lower jaw—that is, upward when the mouth is closed, downward when the mouth is opened, left and right by the respective lateral movement of the lower jaw. With practice, the user can learn to manipulate his jaw in a combination of upward or downward movements and lateral movements to reach the precise electrode he wishes to contact. It will be noted that the dimensions of the electrode housing as shown, namely one inch (2.5 cm) long to one-half inch (1.3 cm.) wide accomodates to the fact that there is greater up and down movement of the jaw than lateral movement, so that more electrodes are provided along the left and right sides of the electrode housing than along the top and bottom.

Figure 14:
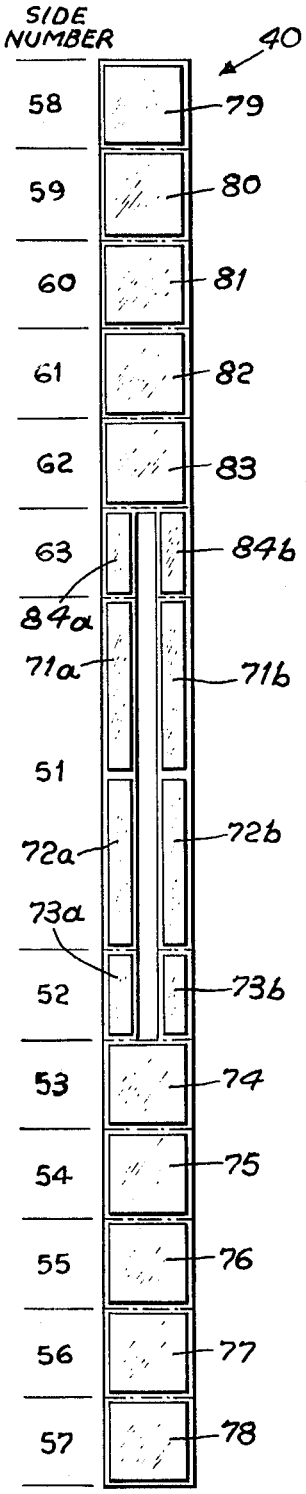
FIG. 14 is a blank of the inner faces of the chin bar electrode housing shown in FIG. 6.
Figure 15:
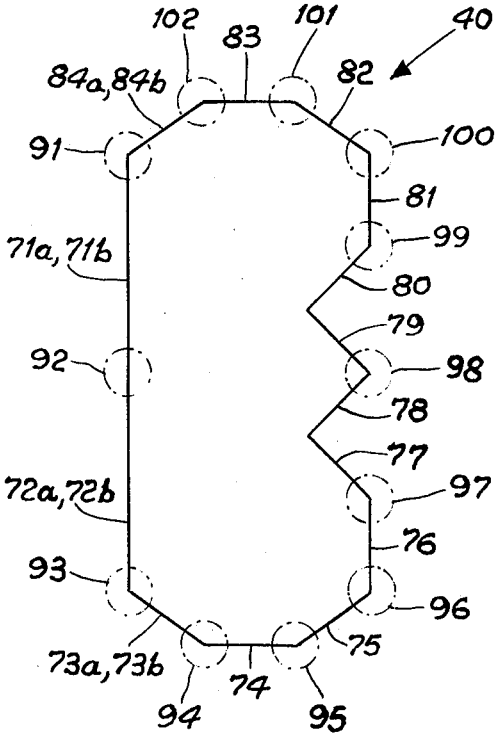
FIG. 15 is a schematic diagram showing the points of contact with more than one electrode in the chin bar electrode housing.

In addition to the computer signals transmitted when the chin bar electrode makes contact with an individual housing electrode, the housing electrodes are electrically interconnected with signal diodes in the circuitry to control the flow of current, to transmit a different signal when two adjacent housing electrodes are contacted simultaneously by the chin bar electrode. The twelve dual contact areas on a thirteen sided FIG. 40 containing fourteen electrodes, as described above, at which the chin bar electrode 19 can establish electrical contact with two electrodes at once are shown schematically in FIG. 15 wherein the numerals 91 through 102 identify the dual electrode contact points which are further illustrated by a circle. Thus, for example, at contact area 92, the chin bar electrode can make simultaneous contact with electrodes 71*a, b* and 72*a, b;* at contact area 101, the chin bar electrode can make simultaneous contact with electrodes 82 and 83. Inspection of the blank form of the electrode housing as shown in FIG. 14 further illustrates the areas of adjacent electrodes which can be contacted by the chin bar electrode. Each chin bar housing electrode is positioned at a predetermined distance from the adjacent chin bar housing electrode and the chin bar electrode is formed with a predetermined cross-sectional area to permit the chin bar electrode to make simultaneous contact with two chin bar housing electrodes. As stated above, in practice each electrode is less than one-sixteenth of an inch (0.2 cm.) from the adjacent electrode while the chin bar electrode 19 is approximately one-sixteenth of an inch (0.2 cm.) in diameter, so that it can establish electrical contact with more than one electrode at a time.

Figure 4:
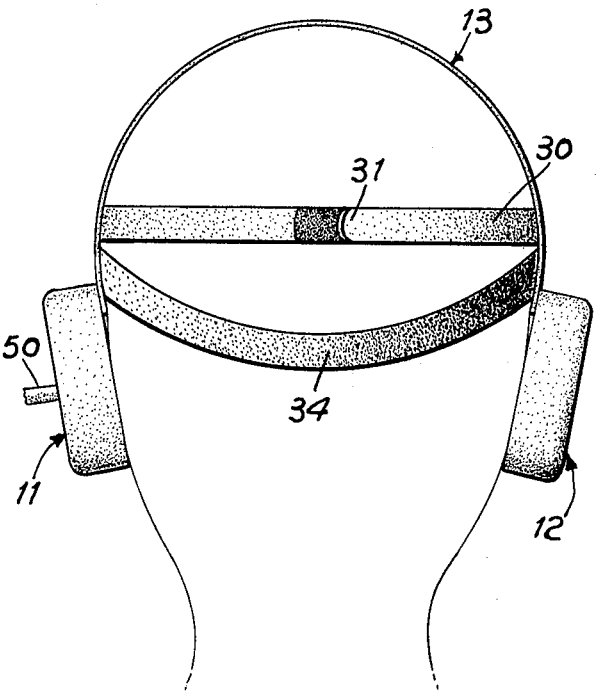
FIG. 4 is a view of the back of the head with device in place.

Additional computer signal contacts are provided by a headband electrode contact system. A second pliable metal boom 24 extends from the top of the headset support bar 13 to a point approximately one-half inch (1.3 cm.) off the user's forehead between the eyes. A C-shaped housing 25 is attached to the distal end of the boom, the arms 26, 27 of which extend toward the forehead of the user. A copper electrode 28, 29 is affixed to the inner surface of each arm 26 and 27 of the housing 25. Each headband housing electrode 28, 29 is electrically connected to alter the nature of the impulses established from the chin bar housing electrodes 71 through 84, when a circuit is completed by contact with a third electrode called the headband electrode described below. A flexible adjustable headband 30 is attached firmly to the forehead of the user by means, for example, of cooperating strips of hook and pile tape, such as Velcro 31, or other adjustable fastening means. The headband 30 passes under headset bar 13 and must rest firmly above the eyebrows of the user. A contact electrode 32, called hereafter the headband electrode, is mounted to extend outwardly from the center portion of the headband 30 to a position between the arms of the C-shaped housing 25. The contact electrode may be formed as a copper ball mounted on a rigid, insulated conductive wire which is electrically connected to complete a circuit between either of the headband housing electrodes 28, 29, which in turn are interconnected to alter the nature of the impulse from a preselected electrode in the chin bar electrode housing 40, as described below. The headband electrode 32 is moved by the movement of the eyebrows, providing three switching possibilities, i.e., no contact when the eyebrows are relaxed, contact with the upper electrode 28 when the eyebrows are raised, and contact with the lower electrode 29 when the eyebrows are lowered, as in a frowning motion. The wiring 48 from the headband housing electrodes 28, 29 and the wiring 33 from electrode 32 is entwined around the headset bar 13 and brought to the right earpiece 11 where it is combined with other wiring into a cable 50 which leads to a computer. To assure that the headset bar 13 remains in a fixed position while the user manipulates his eyebrows and jaw, a support band 34 is attached to the headset bar 13, above the earpieces 11, 12 and fits across the lower part of the back of the head, as shown in FIG. 4.

By using the electrode contacts available in the chin bar housing 40 in combination with the contacts available in the headset housing 25, a user has available sufficient contacts to operate a commercially available computer. Using the chin bar electrode housing described above, the user can selectively establish, by means of the chin bar electrode, 14 positions with one electrode, one position of no contact with any electrode and 12 positions of contact with more than one electrode for a total of 27 different positions of electrical contact. By simultaneously using the three possible positions of the headband system to modify the nature of the impulses transmitted by the chin bar electrode 19 in contact with the chin bar housing electrodes 71 through 84, it is possible to achieve 81 different electrical impulses (27 times 3 equals 81).

Interfacing these 81 potential impulses into a computer would allow the user to program most home or business computers. For example, the commercially available Apple II home computer has 70 different characters on its keyboard. By enabling the user to control a keyboard of a computer, the possibilities of what the user can do is as unlimited as the possibilities of the particular computer being operated. The mute would be able to speak through the computer if the computer was hooked up to a voice synthesizer. Mobility of a much more expansive range is possible by interfacing the computer to a wheel chair. Even the user's own life support machinery, along with movement of a mechanical arm, could be manipulated through existing technology. Perhaps, most important are the occupational opportunities that may become available to the disabled individual in a field such as computer programming.

While the user is searching for a particular character to program into the computer, he will undoubtably skim over unwanted characters. To keep these unwanted characters from being entered into the program, the computer is to be previously instructed not to accept entry of a character until it has been displayed for three or more seconds in an uninterrupted fashion. As the user becomes more proficient in the use of this device, the computer can be programmed to accept a character upon a shorter amount of uninterrupted time.

Figure 16:
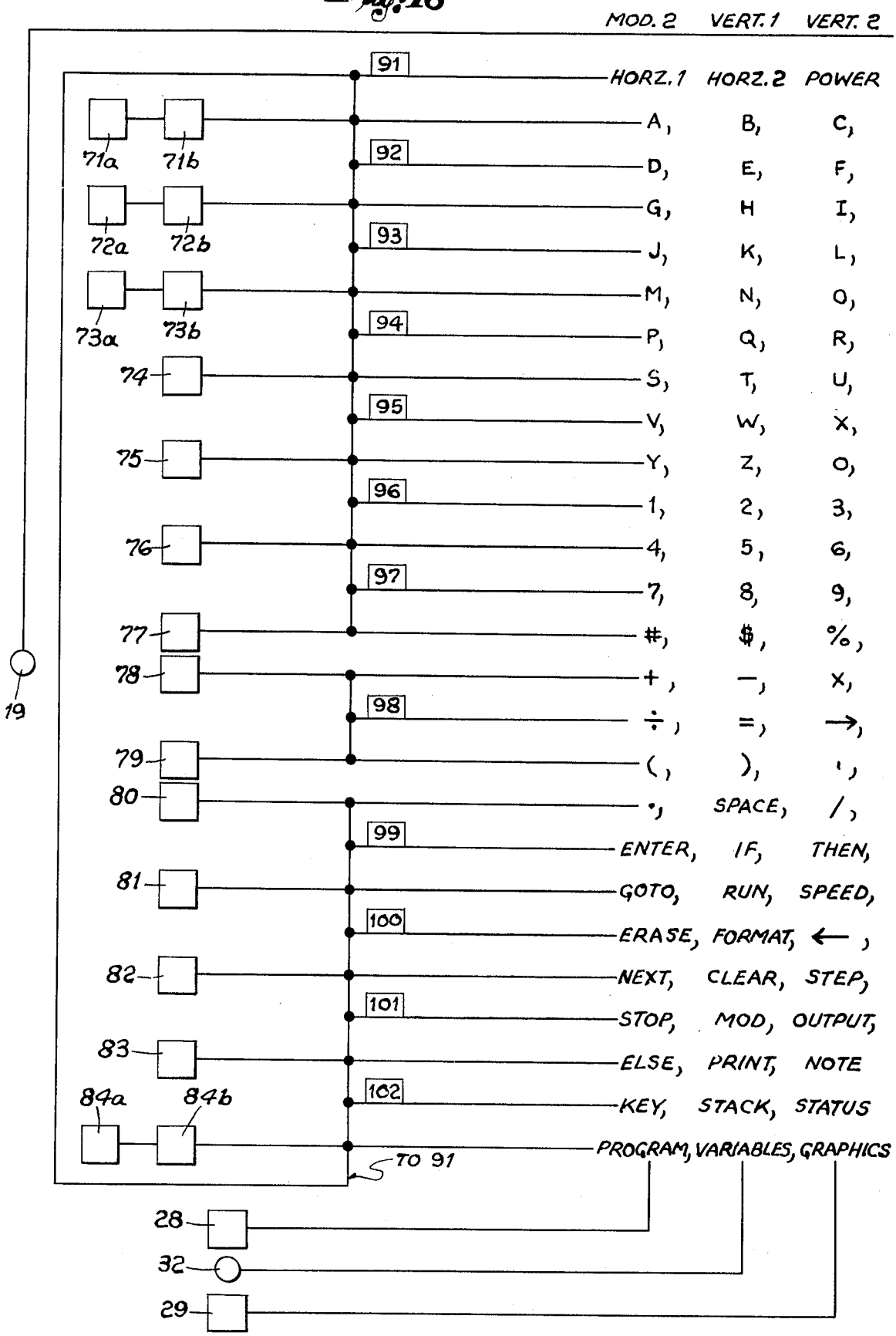
FIG. 16 is a diagrammatic chart of one possible computer programming scheme showing the interrelationship of the individual electrodes in the chin bar electrode housing and in the headband electrode housing.

FIG. 16 is a diagrammatic chart of one possible computer programming scheme, showing the interrelationship of the individual electrodes in the chin bar electrode housing and in the head band electrode housing. The figure shows the relationship between the chin bar electrode 19, chin bar housing electrodes 71 through 84, the contact points between two adjacent chin bar electrodes 91 through 102 interconnected to the headband contact electrode 32 and headband housing electrodes 28, 29 to activate the various characters in the computer. Input to and output from the computer is accomplished for example, as follows: Contact by the chin bar electrode 19 with chin bar housing electrode 71*a, b* completes the circuit to the interface connections of letters A, B, C. Simultaneous contact of the headband electrode 32 with headband housing electrode 28 selects the letter "A" as the signal which enters the computer.

Figure 17A:
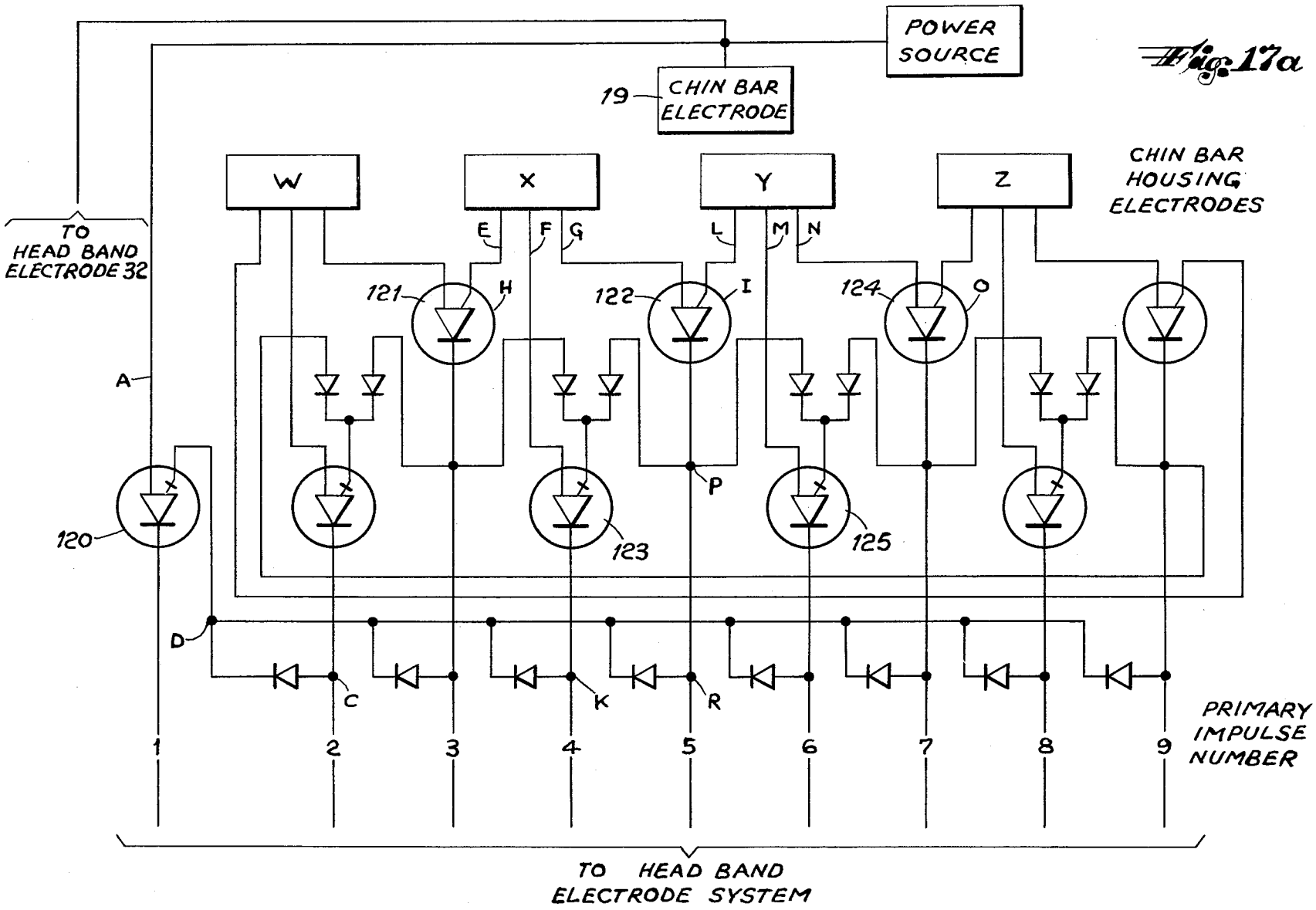
FIGS. 17*a* and 17*b*, when placed with FIG. 17*a* above 17*b* forms a schematic drawing of a portion of the circuitry interconnecting the chin bar electrode system with the headband electrode system.
Figure 17B:
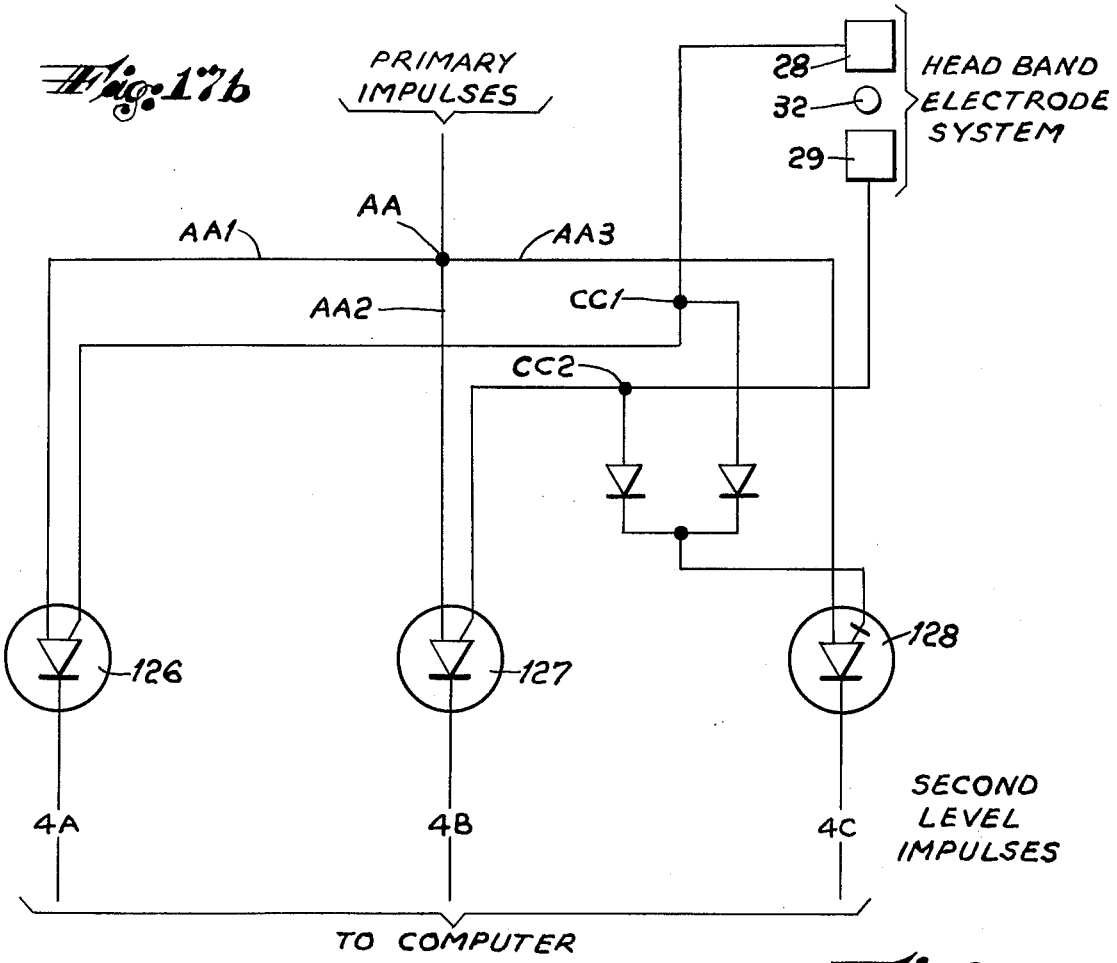

FIGS. 17*a* and 17*b* show a detailed diagram of a portion of the circuitry interconnecting the chin bar electrode system with the headband electrode system to produce 81 signals. FIG. 17*a* shows the schematic for the chin bar electrode 19 and any four of the fourteen chin bar housing electrodes (numbered 71 through 84 in previous figures) and shown in FIG. 17*a* as W, X, Y and Z. It is to be understood that the circuitry for all the chin bar housing electrodes is the same as illustrated herein for four electrodes. FIG. 17*a* shows the chin bar electrode 19 connected to a power source such as, a computer. The chin bar electrode 19 and chin bar housing electrodes are wired through two types of silicon controlled rectifiers—the normally open silicon controlled rectifier (NO SCR) and the normally closed silicon controlled rectifier (NC SCR)—as well as rectifying diodes (also known as signal diodes) each type being shown in FIGS. 17*a* and 17*b* by the standard electrical symbols. The impluses sent to the computer input/output system from the chin bar electrode system are referred to as primary impulses and the impulses which are modified by the interconnection with the headband electrode system, as shown in FIG. 17*b*, are referred to as second level impulses. Referring now to FIG. 17*a*, when the power source is on and chin bar electrode 19 is not in contact with any of the chin bar housing electrodes, current will flow along wire A through NC - SCR 120 to produce the first primary impulse. When the chin bar electrode 19 contacts other chin bar housing electrodes, other primary impulses are produced.

In the event that the chin bar electrode 19 should contact another electrode and cause another primary impulse to be created, for example, if the chin bar electrode 19 contacts chin bar housing electrode W creating a second primary impulse, some of the second impulse will be shunted at junction C to the gate lead of NC - SCR 120 and thereby shut off the first primary impulse to allow the second primary impulse to come through on its own. To prevent current intended for the gate lead of NC - SCR 120 from backing up at junction D and artifically creating other primary impulses, rectifying diodes have been placed between the wires carrying individual primary impulses and junction D.

The following illustrates the circuitry when the chin bar electrode 19 makes contact with a single chin bar housing electrode, such as, electrode X in FIG. 17*a*. When the chin bar electrode 19 contacts electrode X, current flows into wires E, F and G. The current flowing along wire E will travel to NO - SCR 121 and close its gate so that current applied to its input may pass through to its output. However, since no current is being applied to its input, no current passes through this rectifier. The current flowing in wire G travels to NO - SCR 122 where it enters the input lead. However, since no current enters the NO - SCR 122 gate lead in this example, no current passes through. The current travelling through wire F goes to the input lead of NC - SCR 123. This current will continue to flow through NC - SCR 123 because there is no current being applied to its gate. The current that then exits from the output of NC - SCR 123 continues onward as primary impulse 4. Some of the current of this impulse is shunted at junction K to junction D and then to the gate lead of NC - SCR 120, thereby ensuring that primary impulse 4 may continue onto the computer without interference from impulse 1.

As further shown schematically in FIG. 17*a*, when chin bar electrode 19 contacts electrode X and electrode Y simultaneously, current flows along wires E, F and G from electrode X and along wires L, M and N from electrode Y. Current flowing along wire E goes to the gate lead of NO - SCR 121, but since no current is being applied to the input, no current comes through to the output of NO - SCR 121. Current flowing along wire N travels to the input lead of NO - SCR 124, but since no current is being applied to the gate lead, no current comes through the output of NO - SCR 124. Current flowing along wire G goes to the input lead of NO - SCR 122 and will flow from its output by virtue of the fact that current flowing along wire L goes to the gate lead and closes the circuit within NO - SCR 122. The current from the NO - SCR 122 output continues onward as impulse 5, where it is shunted at junction P to also go on to the gate leads of NC - SCR 123 and NC - SCR 125. These two shunts prevent the current from flowing through wires F and M which would cause interference of impulse 5 with impulses 4 and 6.

Rectifying diodes placed before the gate lead of NC - SCR 123 and NC - SCR 125 prevent interference of other impulses with impulse 5 when two electrode combinations other than electrodes X and Y are contacted by chin bar electrode 19. Impulse 5 continues on to junction R where some of the current is shunted on to junction D. This current proceeds from junction D on to the gate lead of NC - SCR 120, thereby ensuring that primary impulse 5 may continue onto the computer without interference from impulse 1.

As a primary impulse is created by the manipulation of the chin bar electrode within the thirteen-sided electrode housing, the impulse created can be further broken down into one of the three second level impulses by the manipulation of the headband electrode system. For example, as shown in FIG. 17*b*, should the chin bar electrode 19 contact electrode X and generate primary impulse 4, this impulse will travel onto junction AA where it will pass through wires AA1, AA2, and AA3. The current travelling along AA1 goes onto the input lead of NO - SCR 126, but because no current is entering the gate lead of this rectifier, no current passes through to the output lead. The current travelling along AA2 goes onto the input lead of NO - SCR 127, but because no current is entering the gate lead, no current passes through to the output lead. The current travelling through wire AA3 travels onto the input lead of NC - SCR 128, where it goes on through to the output, because no current is entering the gate lead. This impulse is identified as 4C. Should headband electrode 32 contact headband housing electrode 29 by the motion of the user's eyebrows, current will flow from headband electrode 32 to headband housing electrode 29. The current from electrode 29 goes to junction CC2 where some of the current is shunted to the gate lead of NO - SCR 127, where this current allows the current flowing through wire AA2 to the input of NO - SCR 127 to continue on as a second level impulse identified as 4B. Impulse 4C will not interfere with impulse 4B, because some of the current from headband housing electrode 29 is shunted at junction CC2 to the gate lead of NC - SCR 128, stopping impulse 4C. Similarly, if headband electrode 32 should contact headband housing electrode 28, current will flow from electrode 28 to junction CC1, where some of the current is shunted to the gate lead of NO - SCR 126, enabling the current in wire AA1 to pass through NO - SCR 126 and exit as second level impulse 4A. Impulse 4C will not interfere with impulse 4A because some of the current shunted at junction CC1 goes to the gate lead of NC - SCR 128, stopping impulse 4C.

Each primary impulse has a circuit of its own, as above described, interconnected with electrodes of the headband system 28, 29 and 32, to breakdown the 27 primary discreet impulses into 81 second level impulses.

The above described invention is readily adapted to allow the user to play video games, such as, the Atari video games. Video games include a module or console unit which is attached to the television set and which processes programmed images onto a television screen. Game cartridges or software are inserted into the modules. They contain microprocessor chips which send a message through the video console unit to the television screen directing what is to appear on the screen. The operator, or one who plays the games, maneuvers an object or objects on the television screen with a controller. There are two different types of controllers commonly used today, depending on the type of game cartridge being used in the video console unit. The Atari manual uses the terms "Joystick Controller" and "Paddle Controller" to describe the two types of controllers. To play a particular video game, the game cartridge is inserted into the console unit and the appropriate controller is plugged into the console unit.

The Joystick Controller is a stick set in a base, which when pushed forward causes an upward motion of an object on the video screen; pulling the stick back toward the operator causes a downward motion of an object on the video screen. Lateral movement to either side causes the object to move in the respective direction.

For Joystick Controller games, movement of the images on the television screen is accomplished by means of five electrodes positioned in the Joystick Controller base. Four of the five electrodes are stationary within the base—one at the top, one at the bottom and one at each side. The fifth electrode is movable and moves as the Joystick Controller is pushed or pulled. When the fifth Joystick electrode establishes contact with one of the four stationary electrodes, a circuit is completed and results in the movement of an object on the television screen depending on which one of the four possible circuits are completed. Diagonal motion of the object on the screen is accomplished by moving the controller to make contact with two adjacent electrodes at one time. Along with the stick of the Joystick Controller, there is usually also a button, which when pressed will cause the object on the television screen to perform something other than movement in a particular direction. In one game, the object may fire a missile, or perhaps the object may disappaar, only to reappear somewhere else on the television screen. A sixth electrode is positioned beneath the botton. When the button is pressed, electrical contact is made between the sixth electrode and an extension of the Joystick Controller electrode, completing a second circuit and causing the eccentric action on the television screen.

The present invention permits the handicapped user to play the Joystick Controller games by eliminating the need to manually operate the Joystick Controller and button by providing means to complete the circuits by movements of the lower jaw to operate the Joystick Controller and by movement of the eyebrows to operate the Joystick button.

As stated above, certain Atari video game cartridges require the use of a Paddle Controller rather than a Joystick Controller. As provided by the manufacturer, the Paddle Controller has a wheel which when turned clockwise will move a figure on the television screen from the left to right side. Similarly, counter-clockwise movement of the wheel will move the figure from the right to left. These movements are accomplished by connecting the Paddle Controller to a circular potentiometer installed in the base of the Paddle Controller. As is well understood in the art, a potentiometer is an electronic component with a control stick which when turned can raise or lower the voltage of an electric current, depending upon the direction in which it is being turned. An ordinary potentiometer has three terminals, but as used in the Atari Paddle Controller, only two terminals are used, i.e., the center terminal and either the right or left terminal are electrically connected to complete a circuit to the video console unit. The Paddle Controller also has a button which when pressed can cause some action other than influence the direction of movement of the image on the television screen. In one game, pressing the button may signal the start of the game, while in another it might change the shape of an object. An electrode on the bottom of the button itself is placed above an electrode positioned below the button in the base of the Paddle Controller base, each electrode being wired to a plug which connects to the video console unit. When the button is pressed down, the two electrodes establish electrical contact which activates the Paddle Controller button program.

The last part of the present invention has application primarily with computer games employing the Paddle Controller. A third pliable boom 23 extends downwardly and forwardly from the second earpiece 12. A bar potentiometer 35 having a straight track 36 is mounted at the distal end of the boom, the track facing the second end of the chin bar 17 and disposed vertically in respect to the chin bar. A control stick 37 extending outwardly at substantially a right angle to the track is formed with a broadened paddle-like head 38 and is held under tension by elastic 39 or other resilient means to the upper end of the potentiometer track 36. The boom 23 is adjusted so that the paddle 38 fits under the end of chin bar 17 when the mouth of the user is closed. The electrical wiring 49 from the two terminals 85 of the potentiometer is entwined along the boom 23, across the headset bar 13 and is then combined with other wires into cable 50 leading to the plug to the video console unit. The potentiometer is constructed so that the track 36 in which the control stick 37 slides is approximately one inch long (2.5 cm).

The user of the present invention controls the left to right and right to left motion of the image on the television screen by raising and lowering his jaw to move the control stick 37 of the potentiometer 35. The Paddle Controller button program is connected to the headband electrode system as described above and is operated by the movement of the eyebrows.

Figure 18:
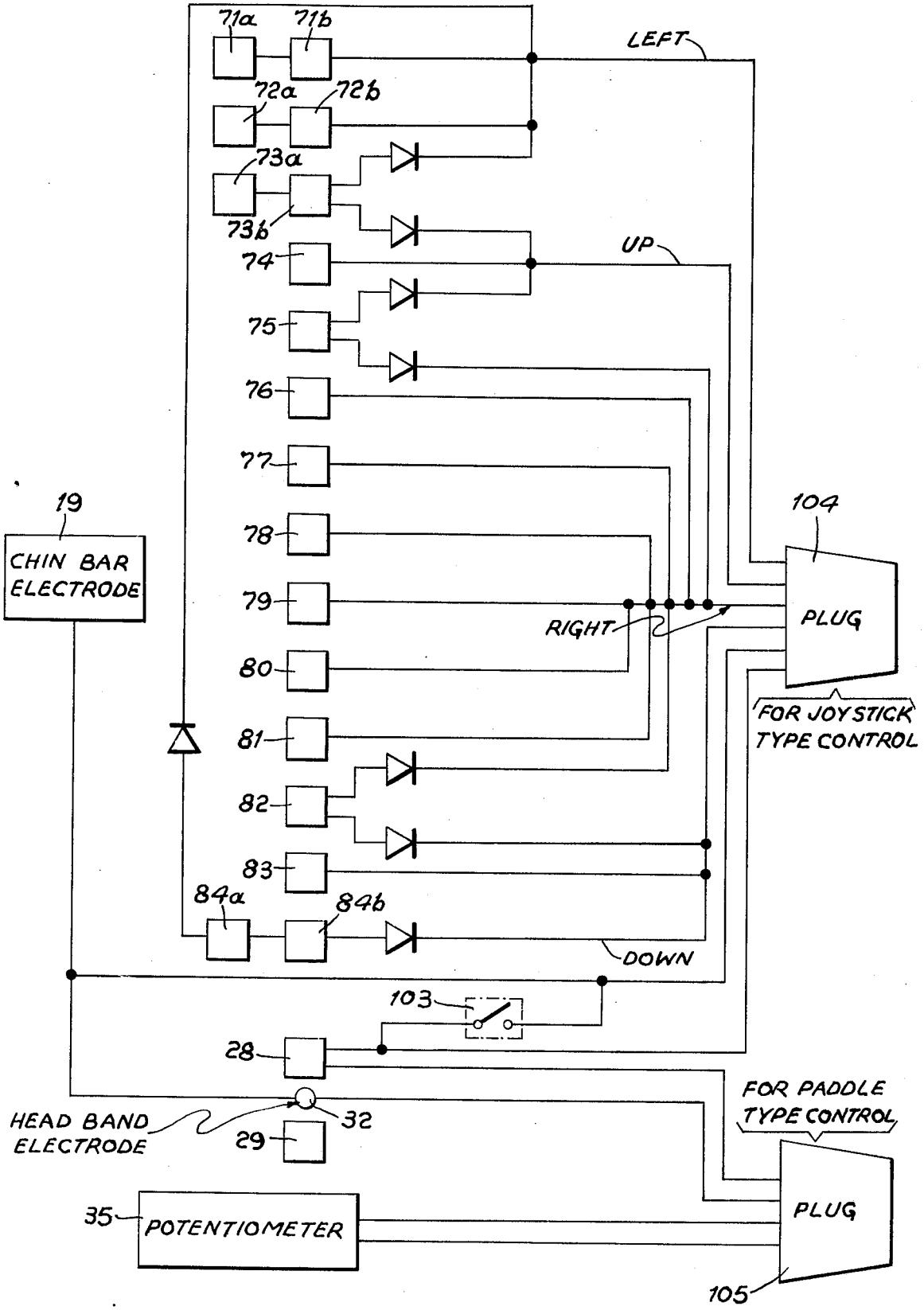
FIG. 18 is a schematic drawing of the circuitry for adopting the present invention for use with Atari type video games.

FIG. 18 is a schematic drawing of the circuitry for adopting the present invention for use with Atari type video games. The electrodes are given the same numerals as are shown in the figures described above. In order to achieve four contact points to operate the Joystick Controller, the fourteen electrodes in the chin bar electrode housing 40 are electrically interconnected with rectifying diodes to control the flow of current to achieve four principal contacts which are equivalent to the four stationary electrodes in the Atari Joystick Controller base, as well as to provide for simultaneous contact with two electrodes to produce diagonal movement of the game figures. The wires are connected to the Joystick Controller plug 104. When the chin bar electrode 19 makes contact with any one of the interconnected group of electrodes, the programmed motion of the game image occurs on the television screen. Thus, for example, contact of the chin bar electrode 19 with chin bar housing electrodes 71*a, b* and/or 72*a, b* produces a movement of the image to the left; contact of chin bar electrode 19 with chin bar housing electrode 74 produces an upward movement of the image; contact of the chin bar electrode 19 with any of the group of chin bar housing electrodes 76 through 81 produces a movement of the image to the right; and contact of the chin bar electrode 19 to chin bar housing electrode 83 produces a downward movement of the image.

As further illustrated in FIG. 18, electrodes 73*a* and 73*b*, 75, 82 and 84*a* and 84*b* are electrically connected to more than one wire to the controller plug. Each wire corresponds to a contact in the video console unit through the plug. Therefore, contact of chin bar electrode 19 to chin bar housing electrode 75 sends electrical impulses to the wires that lead to the contacts corresponding to both upward motion and rightward motion. In this way, a diagonal motion, i.e., upward and to the right of the image on the video screen is obtained. Likewise, contact of the chin bar electrode 19 with electrodes 84*a* and/or 84*b* produces downward to the left diagonal motion of the image; contact with electrodes 73*a* and/or 73*b* produces upward to the left diagonal motion; and contact with electrode 82 produces downward to the right diagonal motion. The headset electrode system is interconnected with the Joystick Controller system to operate the Joystick Controller button. Thus, contact of the headband electrode 32 with the upper headband housing electrode 28 by means of the upward movement of the eyebrows activates the button program. Since only one signal is necessary to activate the button program, the lower headset housing electrode 29 is not connected to the video game circuitry.

As further shown in FIG. 18, the Paddle Controller comprises a potentiometer 35 electrically connected to a separate plug 105 with the headset electrode system interconnected to operate the Paddle Controller button program as described above.

As previously described, when the user raises his eyebrows, the headband electrode 32 contacts electrode 28 and the electrical circuit established is the same as if the button of either the Paddle Control of Joystick Control were manually pressed. Some of the Atari type game cartridges require almost constant activation of this button which can result in fatigue of the user's eyebrows or the thumb of the normal player. To prevent this fatigue, an On/Off switch 103 is included in the circuitry shown in FIG. 18 that connects the wire from the headband electrode 32 and the wire from electrode 28, so that current will flow between the two when the switch is in the "on" or "closed" position. When the switch is in the "on" position the current will flow unimpeded and independently of the user's manipulations of the headband electrode. Normal control of the headband electrode 32 and headband housing electrode 28 will be returned to the user only when the switch is in the "off" or "open" position. The manipulation of this switch must done by one who is not as handicapped as those for whom this device is intended, that is, by a person who can operate a switch. Although switch 103 can be used with both the Joystick or Paddle mode of operation, its usual application would be when this device is used in its Joystick mode. For example, the "Space Invaders" game cartridge, made by Atari, involves a space ship which the operator moves horizontally across the television screen by means of the Joystick and at which he shoots missiles by pressing the button almost constantly. Locking the button control in a closed or "on" position by means of switch 103 helps to avoid excessive fatigue in the eyebrows of the user of this device.

Figure 19:
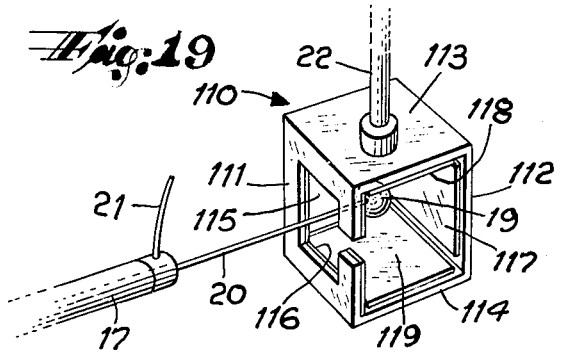
FIG. 19 is a perspective view of a modified form of the electrode housing with chin bar electrode in place.
Figure 20:
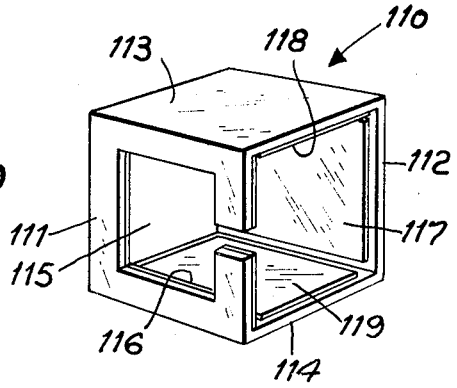
FIG. 20 is an enlarged perspective view of the modified form of the electrode housing shown in FIG. 19.
Figure 21:
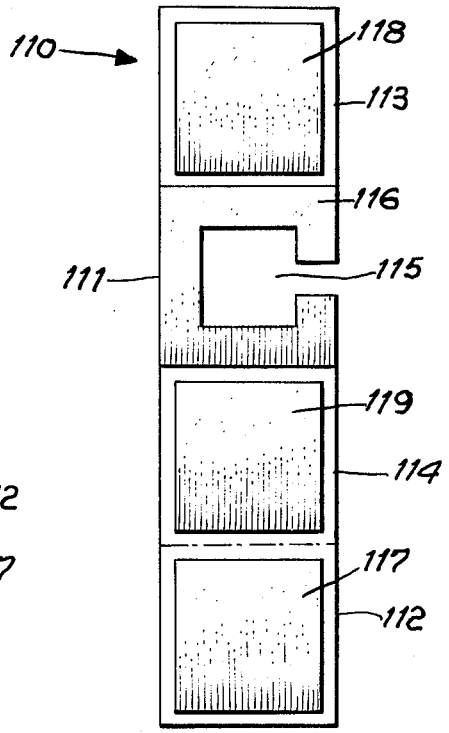
FIG. 21 is a blank of the inner faces of the electrode housing shown in FIG. 19.

FIGS. 19, 20 and 21 illustrate a modified form of the chin bar electrode housing of the present invention generally designated by the reference numeral 110. This form of the electrode housing has especial use where this invention is to be used for playing video games, rather than to operate a computer. The electrode housing 110 is a four sided figure having a left side 111, right side 112, top 113 and bottom 114, the four sides being shaped as a rectangle having two open sides. The top of the rectangle 113 is attached to the distal end of the left boom 23 in alignment with the chin bar electrode 19. The left side of the housing 111 adjacent to the chin bar electrode is formed with an opening 115 to allow the chin bar electrode 19 to be inserted into the interior of the housing. An electrode is attached to the inner face of each side of the housing, the electrodes being designated by the numerals 116, 117, 118, 119 on sides 111, 112, 113 and 114 respectively. The electrodes may be copper strips glued to the inner faces of the housing or affixed by other known means. Electrode 116, which is affixed to side 111 of the housing is formed with a center opening to fit on the side wall around the opening 115 through which the chin bar electrode 19 passes into the housing 110. Each of the four housing electrodes are wired and the wires brought together to form a cable 21 leading to the right earpiece as described above. To operate the Joystick Controller with this modification, the chin bar electrode 19 is inserted into the housing and the housing is adjusted by means of the right boom 22, so that the chin bar electrode does not make contact with any side when the mouth is in a slightly opened position. By closing his mouth, the user makes contact between the chin bar electrode 19 and the top electrode 118 thereby causing the game figure to move upward on the television screen as if the Joystick handle had been manually moved away from the user. Similarly, when the jaw is lowered, contact is made between the chin bar electrode 19 and the bottom electrode 119; when the jaw is moved to the left, contact is made between the chin bar electrode 19 and the left electrode 116; when the jaw is moved to the right, contact is made between the chin bar electrode 19 and the right electrode 117, each contact causing the respective motion of the game figure on the television screen. By combining the opening and closing movement of the jaw with the lateral movement of the jaw, the user can make simultaneous contact of the chin bar electrode with two of the electrode housing electrodes to cause diagonal movement of the game figure on the television screen. The modification of the movement of the figure on the television screen is accomplished by interconnection of the chin bar electrode housing connections with the headband electrode system as described above. The modification as shown in FIGS. 19 through 21 may be constructed as a cube with all side walls approximately one-half inch (1.3 cm.) long and one-half inch (1.3 cm.) wide.

The foregoing is considered as illustrative only and while specific embodiments have been described with some particularity, many modifications and variations of those embodiments will occur to those skilled in the art without deviating from the invention. Accordingly, it is to be understood that, within the scope of the appended claims, the invention may be practiced other than as specifically described or shown.

What is claimed herein is:

1. A device for use by a quadriplegic to operate a computer, video game or the like by the use of movements of the jaw and eyebrows comprising:

a. a semi-circular headset support bar for fitting across the top of a human head;

b. two earpieces, one at each end of the headset support bar, for fitting over ears;

c. an adjustable chin strap detachably mounted to the earpieces;

d. a chin cup formed with a concavity to accomodate a chin, attached to the center of the chin strap;

e. a chin bar horizontally mounted on the chin cup, extending outwardly to at least the ends of the earpieces;

f. a chin bar electrode mounted on one end of the chin bar;

g. a pliable boom extending downwardly and forwardly from an earpiece to one end of the chin bar;

h. a chin bar electrode housing mounted on the distal end of the boom, said housing being formed with a plurality of peripheral sides and having a left end, a right end, top and bottom, one end being formed with a channel to provide an opening through which the chin bar electrode can be inserted into the interior of the housing; and i. a plurality of electrodes mounted on the inner faces of the sides of the electrode housing, the chin bar electrode and each individual chin bar housing electrode being electrically connected to complete a circuit to actuate a computer signal when the chin bar electrode contacts a housing electrode, contact being made by the movement of the user's chin.

2. A device in accordance with claim 1 further comprising:

(a) a second pliable metal boom extending forwardly from the headset support bar to an area that will be above the forehead between the eyes and above the eyebrows;

(b) a housing attached to the distal end of the boom, the housing having a plurality of sides and formed with an opening toward the forehead of the user;

(c) a plurality of electrodes mounted on the upper and lower inner faces of the sides of the housing;

(d) a flexible, adjustable headband fitted around the head of the user above the eyebrows; and (e) an electrode mounted to extend outwardly from the center portion of the headband to a position within the headband housing between the headband housing electrodes, the headband electrode and headband housing electrodes being electrically connected to complete a circuit to actuate a computer signal and interconnected with the chin bar electrode system to complete a second circuit to actuate a computer signal when the head band electrode contacts a head band housing electrode, contact being made by the movement of the eyebrows.

3. A device in accordance with claim 2 further comprising:

(a) a third pliable metal boom extending downwardly and forwardly from the second earpiece to the second end of the chin bar;

(b) a sliding bar potentiometer having a straight track mounted on the distal end of the boom, the track facing the end of the chin bar and disposed vertically in respect to the chin bar;

(c) a control stick slidably, movably, operably mounted in the potentiometer track and extending outwardly at substantially a right angle to the potentiometer track, said control stick being positioned under the end of the chin bar by adjustment of the boom; and (d) resilient means urging the control stick toward the upper end of the potentiometer track, the potentiometer being electrically connected to complete circuits to actuate computer signals when the control stick is moved to a lower position within the potentiometer track by the downward movement of the jaw and being electrically interconnected to the headband electrode system to complete a circuit to actuate a second computer signal when the potentiometer control stick is moved simultaneously with the operation of the headband electrode system.

4. A device in accordance with claim 1 wherein the electrode housing has thirteen sides.

5. A device in accordance with claim 1 wherein the chin bar electrode is in the form of a ball.

6. A device in accordance with claim 4 wherein fourteen electrodes are attached to the inside faces of the chin bar electrode housing sides.

7. A device in accordance with claim 1 wherein the individual sides of the end of the electrode housing, which are formed with a channel are provided with electrodes which are split, one side of each electrode positioned on each side of the channel, the split electrodes being electrically connected in series to act as a single electrode when contact is made with the chin bar electrode.

8. A device in accordance with claim 1 wherein the size of the chin bar electrode and the distance between adjacent chin bar housing electrodes is predetermined to permit the chin bar electrode to contact two adjacent housing electrodes simultaneously, the adjacent electrodes being electrically interconnected to complete a circuit to actuate a computer signal when the chin bar electrode contacts two adjacent electrodes.

9. A device in accordance with claim 2 wherein the headband housing is C-shaped, the two arms of which will extend toward the forehead of the user.

10. A device in accordance with claim 9 wherein an electrode is affixed to the inner face of each arm of the C-shaped housing.

11. A device in accordance with claim 3 wherein the potentiometer stick is formed with a paddle-like head.

12. A device in accordance with claim 2 wherein the chin bar electrode system is electrically connected to send signals to a video game Joystick Controller program and the headband electrode system is electrically interconnected to send signals to the Joystick Controller button program.

13. A device in accordance with claim 12 further comprising switch means in the headband electrode system operably connected for the user to select between a continuous closed circuit and the normal open circuit to operate the Joystick Controller button program.

14. A device in accordance with claim 3 wherein the potentiometer is electrically connected to send signals to a video game Paddle Controller program and the headband electrode system is electrically interconnected to send signals to the Paddle Controller button program.

15. A device in accordance with claim 14 further comprising switch means in the headband electrode system operably connected for the user to select between a continuous closed circuit and the normal open circuit to operate the Paddle Controller button program.

16. A device in accordance with claim 1 wherein:

(a) the electrode housing comprises a four-sided rectangular figure having a left side, a right side, a top and a bottom, one side being formed with an opening through which the chin bar electrode can be inserted into the interior of the housing;

(b) an electrode is mounted on each of the inner faces of the sides of the housing, the electrode mounted on the side of the housing having an opening being formed to substantially surround the opening, each electrode being a predetermined distance from the adjacent electrode, the electrodes being electrically connected to send signals to a video game Joystick Controller program when a circuit is completed by contact with the chin bar electrode.

17. A device in accordance with claim 16 wherein the chin bar electrode is formed of a predetermined size to permit contact with two adjacent electrodes simultaneously, the adjacent electrodes being electrically interconnected to send a signal to a video game Joystick Controller program when a circuit is completed by contact with the chin bar electrodes.

18. A device in accordance with claim 17 wherein the length and width of each of the sides are equal.

19. A device in accordance with claim 3 further comprising a flexible support band attached to the headset bar which will fit across the lower part of the back of the head.

* * * * *